US010482853B1

(12) United States Patent
Nagahara

(10) Patent No.: US 10,482,853 B1
(45) Date of Patent: Nov. 19, 2019

(54) PAD RING RETAINER

(71) Applicant: Kanichi Nagahara, Chelmsford, MA (US)

(72) Inventor: Kanichi Nagahara, Chelmsford, MA (US)

( * ) Notice: Subject to any disclaimer, the term of this patent is extended or adjusted under 35 U.S.C. 154(b) by 0 days.

(21) Appl. No.: 16/173,634

(22) Filed: Oct. 29, 2018

(51) Int. Cl.
*G10D 9/04* (2006.01)
*G10D 7/02* (2006.01)

(52) U.S. Cl.
CPC ..... *G10D 9/043* (2013.01); *G10D 7/026* (2013.01)

(58) Field of Classification Search
CPC ..... G10D 9/043; G10D 7/026
See application file for complete search history.

(56) References Cited

U.S. PATENT DOCUMENTS 5,469,771 A * 11/1995 Wasser ..... G10D 9/043 84/385 P
6,015,946 A * 1/2000 Yamaryo ..... G10D 9/043 84/380 R
6,028,256 A * 2/2000 Straubinger ..... G10D 9/043 84/380 R
6,664,455 B2 * 12/2003 Aoki ..... G10D 9/043 84/385 A
6,683,235 B2 * 1/2004 Aoki ..... G10D 9/043 84/385 A
6,940,007 B2 * 9/2005 Schmidt ..... G10D 9/043 84/385 P
6,972,361 B2 * 12/2005 Shibamiya ..... G10D 9/043 84/385 P
7,459,621 B2 * 12/2008 Straubinger ..... G10D 9/043 84/385 P
9,583,078 B1 * 2/2017 Nagahara ..... G10D 9/043
2003/0070531 A1 * 4/2003 Aoki ..... G10D 9/043 84/385 P

* cited by examiner

*Primary Examiner* — Robert W Horn
(74) *Attorney, Agent, or Firm* — Lambert Shortell & Connaughton; Gary E. Lambert; David J. Connaughton, Jr.

(57) ABSTRACT

A pad for a woodwind instrument is provided. The pad is formed of a pad material, and a pad ring retainer about a perimeter side edge of the pad material. The pad ring retainer is adapted to support the pad material as well as any membrane which encloses the pad material. As constructed, the pad utilizes the ring retainer as a type of internal skeleton to support the pad but also provide added flexibility and versatility to the pad.

15 Claims, 5 Drawing Sheets

PAD RING RETAINER

BACKGROUND OF THE INVENTION

Field of the Invention

The present invention relates generally to pad assemblies for woodwind instruments, particularly flutes. This invention relates to a pad for sealing woodwind toneholes which has numerous advantages over the prior art.

Description of Related Art

Different musical pitches are realized on woodwind instruments such as the modern flute by means of closing various toneholes along the length of the flute while playing. It is critical to the proper sounding of the instrument that the toneholes are completely and firmly sealed off around their circumference, and that this sealing occur simultaneously around the toneholes' entire circumference. The size of the toneholes on the modern flute necessitate the use of a cup and pad arrangement, the tonehole being too large and numerous to be closed with only ten comparatively small human fingers. These pads need to maintain even contact with the tonehole. Uneven contact results in, among other things, a gap through which air can leak and disrupt the instrument's sound. While instrument makers such as flute makers seek to avoid such a situation, it does occur on occasion and can occur or be worsened through use or wear and tear of the instrument and/or improper maintenance as well as damage.

On a modern professional level flute there are at least two main types of cups, those with a center hole and those without a center hole. There are typically three types of pad installation. The first type is a "spud and washer" design whereby the pad is secured into the cup by means of screw and washer. The screw is inserted into its threaded receiver or "spud", and then tightened to hold the washer on top of the pad, which holds the pad in place in the cup. The second type of arrangement may be described as a "bushing and chimney" design, the chimney being the center hole in a cup, whereby the pad is held in its cup by means of a flanged bushing pressed into the central hole of the pad. In the third type of arrangement, the pad is simply held in place with a backing of glue or resin and is not part of the current invention.

There are problems related to each method of attachment. In the first type of installation slight deviations occur resulting in imperfect alignment and concentricity due to the nature of soldering of the spud, screw threads, tightness or lack of, and solder flow leveling. Spuds are typically soldered into place inside the cup, but if too little solder is used, the spud may not properly seat against the cup. Conversely if too much solder is used, the spud may float out of its optimum orientation. In the second type of installation, the bushing is being pressed down until sufficient resistance is felt. If further pressure is applied the cup could become deformed and does so almost all cases.

SUMMARY OF THE INVENTION

The subject matter of this application may involve, in some cases, interrelated products, alternative solutions to a particular problem, and/or a plurality of different uses of a single system or article.

In one aspect, a pad for a tonehole cover of a woodwind instrument is provided. The pad comprises a pad material, and a pad ring retainer. The pad ring retainer has a vertical wall at least partially surrounding a vertical edge of the pad material, and may have a lower side with an inward taper extending inwardly from the vertical wall towards an opposite side of the ring. This inward taper is typical in many embodiments, but is not necessarily required by the present invention.

In another aspect, a pad assembly for a woodwind instrument is provided. The pad assembly is formed of a key cup, and a pad secured to the key cup. The pad comprises a pad material, and a pad ring retainer. The pad ring retainer has a vertical wall at least partially surrounding a vertical edge of the pad material, and may have a lower side with an inward taper extending inwardly from the vertical wall towards an opposite side of the ring. The pad, in this embodiment, has a membrane (often referred to as "pad skin") surrounding the pad material and the pad ring retainer, thereby enclosing the pad.

In yet another aspect, a woodwind instrument is provided. The woodwind instrument may have a body, a plurality of toneholes formed into the body, and a plurality of key cups, each positioned above and adjacent to one of the plurality of toneholes. Each key cup is movable between an open position allowing air flow through the adjacent one of the plurality of toneholes, and a closed position preventing air flow through the same. A pad is secured to each of the plurality of key cups. Each pad comprises a pad material, and a pad ring retainer. The pad ring retainer has a vertical wall at least partially surrounding a vertical edge of the pad material, and a membrane surrounding the pad assembly. Preferably, though not necessarily, the retaining ring may have an inward taper.

DETAILED DESCRIPTION

Figure 1:
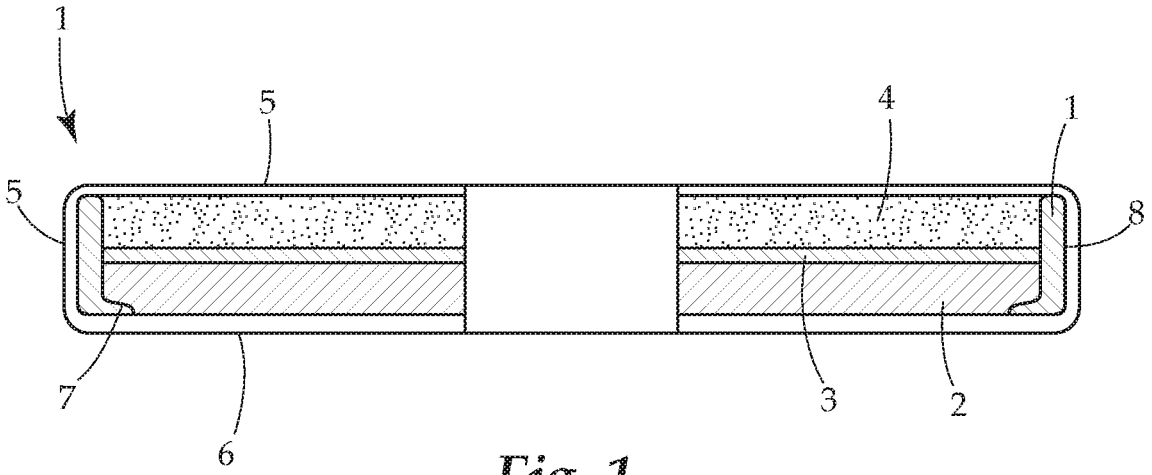
FIG. 1 provides a cutaway view of one embodiment of the pad of the present disclosure.

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

The present disclosure relates to woodwind instruments such as a flute. Generally, the present disclosure concerns a pad for a tonehole cover of a woodwind instrument which has an internal support structure allowing for full support of the pad, including any outer membrane. The pad includes a pad material, and a pad ring retainer which has a vertical wall surrounding a vertical edge of the pad material. In some embodiments, the ring retainer has a minimal lower side with an inward taper extending inwardly from the vertical wall to form a lip preventing the pad from slipping through. With or without the lip, the pad may still function and in some cases may be used. Embodiments having an inward taper on the ring retainer can use the shape to receive the pad material, with the taper providing a compressive force to the pad material, supporting it and holding it in place. The pad thus described may be installed in a key cup for a woodwind instrument to form a pad assembly. These pad assemblies in turn may be used to construct woodwind instruments to use the inventive ring retainer.

A membrane surrounds the pad material and the pad ring retainer. Typically, this membrane is a thin natural material such as cow intestine, but is not limited thereto, and could be any thin, flexible material. The membrane similarly often surrounds the pad at an inner diameter opening, conforming the rim of the pad (in pad embodiments having an inner opening). The pad ring retainer forms a supporting surface over which the membrane can make an angled transition from the vertical direction to the horizontal direction, allowing for a flat top surface of the pad (See FIG. 1). This flat shape greatly enhances the complete outer seal between the pad and key cup. By contrast, a pad without the retainer structure is soft and causes a curving, imprecise transition with a top pad sealing surface which is downwardly sloping from center to outer edge. Such a mis-shaped pad resembles a torroid, rather than the desired cylindrical shape of the present pad taught herein.

The pad material may be any material capable of being used as a tonehole pad. In certain embodiments, the pad material may have more than one layer. For example, the pad may have a base layer, and a cushion layer, the cushion layer being softer than the base layer. In a further embodiment, the pad material may have a base layer, a cushion layer, and a film between the base a cushion layer, the cushion layer being softer than the base layer. Generally, the pad material is at least somewhat flexible, rather than rigid. This allows, among other things, shimming to change shape of the pad, as discussed below with respect to FIGS. 4A-C.

The pad ring retainer is typically formed of a plastic material, but it should be understood that any material resilient enough to contain and support the pad may be used. Other materials may include fabric, metals, polymers, paper, and the like.

The pad, and specifically the ring retainer eliminates the need for a base to which the pad must be attached, and exposes the core pad material layer for direct and precise shimming. The pad's orientation to the tonehole can be affected by several factors, including finger pressure, humidity, temperature, and climatic changes, etc. Most flutists can detect a tonehole to pad leak as small as one thousandth of an inch. The ability to shim directly onto the pad provides a desirable, firm yet flexible condition of pad orientation. Reduction of the cup retainer bottom portion to a rim only is therefore advantageous. Here the pad itself becomes the critical element of uniform sealing resulting from its flexibility and precise shimming capability. Additionally this allows for minimum shimming adjustments, to compensate for tonehole and key cup irregularities. Some common irregularities include: out of round, out of alignment, uneven, warped or otherwise misshapen, including machining aberrations and to a degree even slight damage. This allows for a better seal and also makes it easier to shim the key cup if needed. In this way, the designs flexibility enhances the mechanical aspects or means regardless of the three methods for attaching pads to key cups on modern professional flutes.

The ring retainer is useful to reduce or eliminate typical pillowing, mushrooming, or muffin top effects caused by traditional pad/cup arrangements. As noted above, these undesirable shapes are due to deformation of the pad surface resulting from a rigid or semi-rigid pad/cup and retainer design which allows the entire retainer assembly to pivot undesirably when the pad is leveled for proper alignment. This greatly reduced bottom surface area essentially leaves a one piece flexible outer collar and bottom rim, thus enabling the whole pad and whatever assembly it is installed in nearly infinite flexibility and allowing minute deviance to the entire pad assembly. These minute irregularities can then be accommodated with minimum shimming whereas rigid and even semi-rigid retaining cup designs with full bottoms, (with the exception of the inner chimney hole style) are unable to be as precise, causing the affected area to be spread over a larger surface and thus requiring additional shimming.

Turning now to FIG. 1, a side cutaway view of an embodiment of the pad for the tonehole cover is shown. In this view, the pad 10 has a ring shape with an outer diameter and a central opening. A membrane 5 surrounds the pad 10 top, bottom, outer sides, and inner sides, thereby enclosing the pad 10. The pad material, in this embodiment, is formed of a pad base material 2, a film layer 3, and a soft pad foam 4. A back label 6 is positioned on a bottom of the pad 10. In some embodiments, this label may be an adhesive with a peel-off cover. The pad 10 has a ring retainer 8 around its outer diameter. The ring retainer 8 defines a vertical wall and an inward taper 7 at a bottom. In certain embodiments, this taper 7 may extend further inward to varying diameter positions of the pad. As noted, this pad 10 may be used as a pad in any woodwind instrument, such as a flute, piccolo, and the like.

Figure 2:
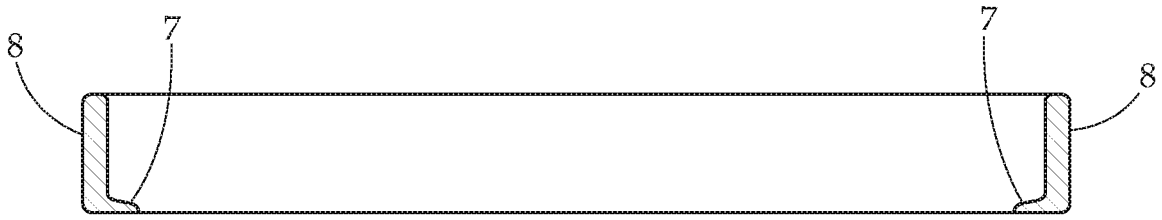
FIG. 2 provides a side cutaway view of one embodiment of the pad ring retainer of the present disclosure.

FIG. 2 shows a side cutaway views of an embodiment of the pad ring retainer. The ring retainer 8 has a vertical wall and short tapered portion 7, without a core or base.

Figure 3:
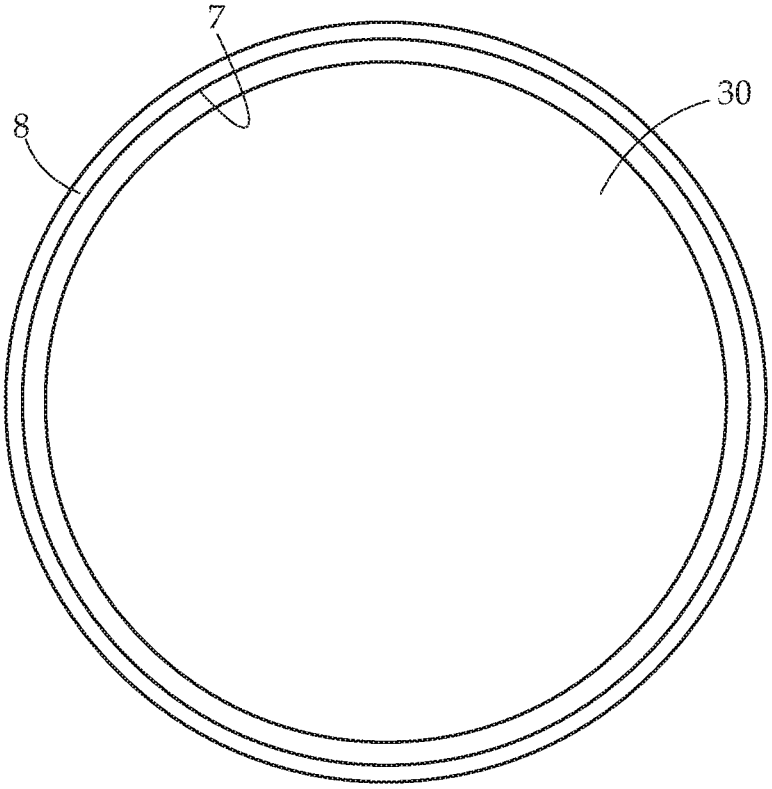
FIG. 3 provides an elevation view of one embodiment of the pad ring retainer of the present disclosure.

FIG. 3 shows an elevation view of the embodiment of the pad ring retainer of FIG. 2, and the opening 30 defined by the ring retainer 8 can be seen.

Figure 4A:
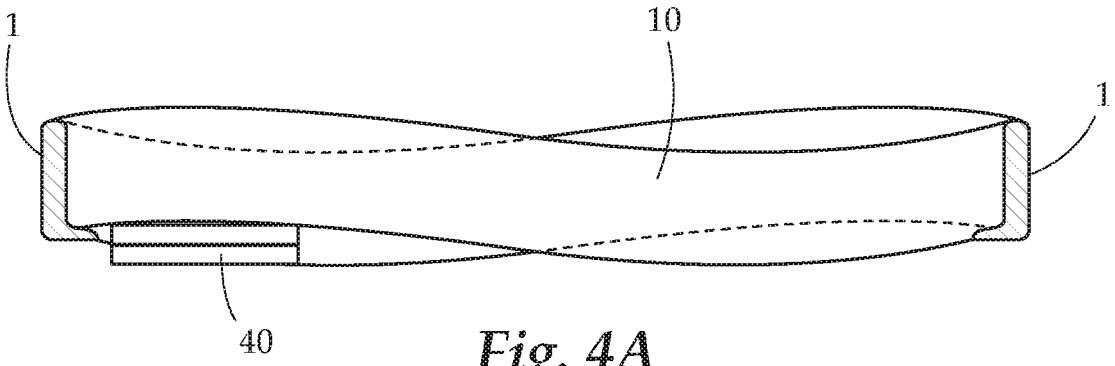
FIG. 4A provides a view of an embodiment of a pad of the present disclosure being shaped using shims.
Figure 4B:
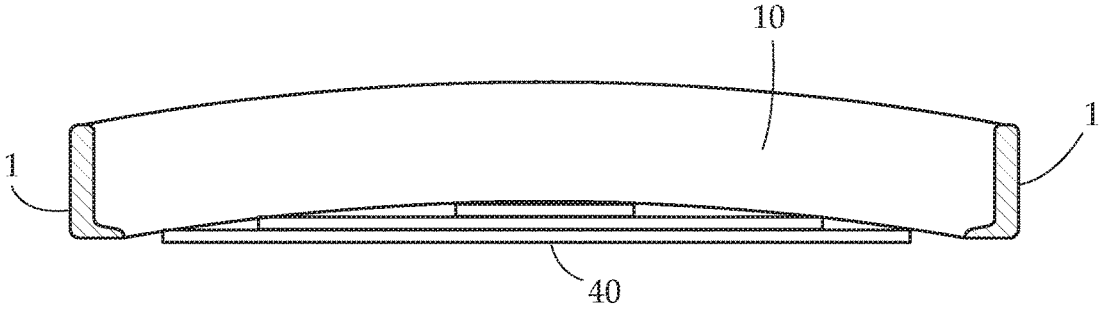
FIG. 4B provides a view of another embodiment of a pad of the present disclosure being shaped using shims.
Figure 4C:
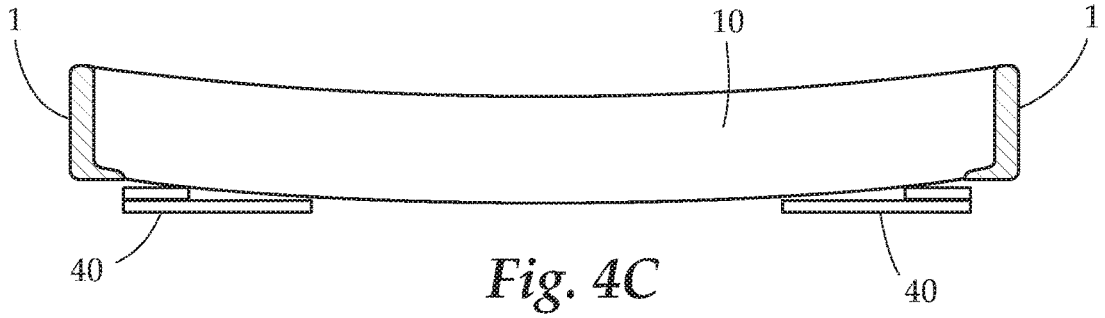
FIG. 4C provides a view of yet another embodiment of a pad of the present disclosure being shaped using shims.

FIGS. 4A, 4B, and 4C provide side views demonstrating various ways to shim the pad position. As can be seen, the pad 10, including ring retainer 8 is positioned such that shims 40 adjust the shape of the pad to accommodate for imperfections in a pad assembly and/or instrument. In this embodiment, the shimming 40 is applied directly to the pad material. As the pad material is flexible, it allows for more precise shimming compared to the prior art. FIG. 4A shows a side shimming; FIG. 4*b* shows a central shimming forming a convex pad shape; and FIG. 4C shows left and right side shimming, forming a concave pad shape. By way of further example, with a rigid base, the embodiment of FIG. 4C could not be easily achieved because instead of the curving shape, the pad 10 would simply be lifted up due to the rigid base supporting the center as the side is lifted.

Figure 5:
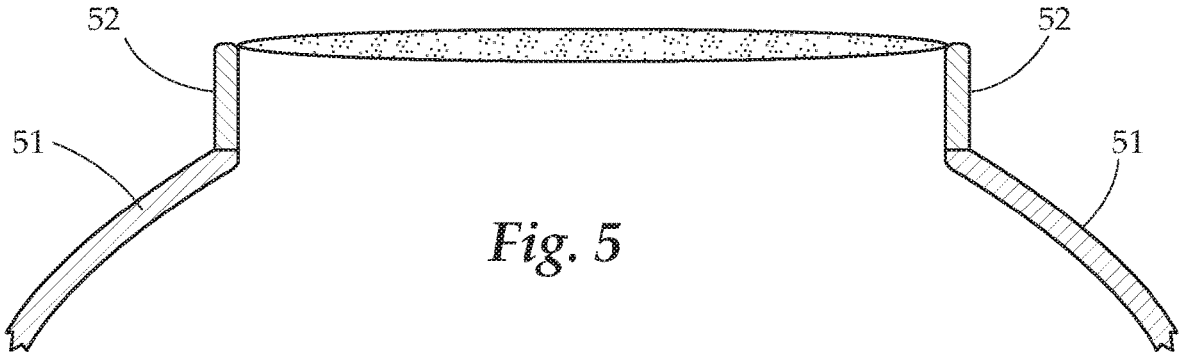
FIG. 5 provides a side cut away view of an embodiment of a woodwind instrument and tonehole.

FIG. 5 provides a side cutaway view of a woodwind instrument 51 and tonehole 52 which is to be covered by the pad 10.

Figure 6A:
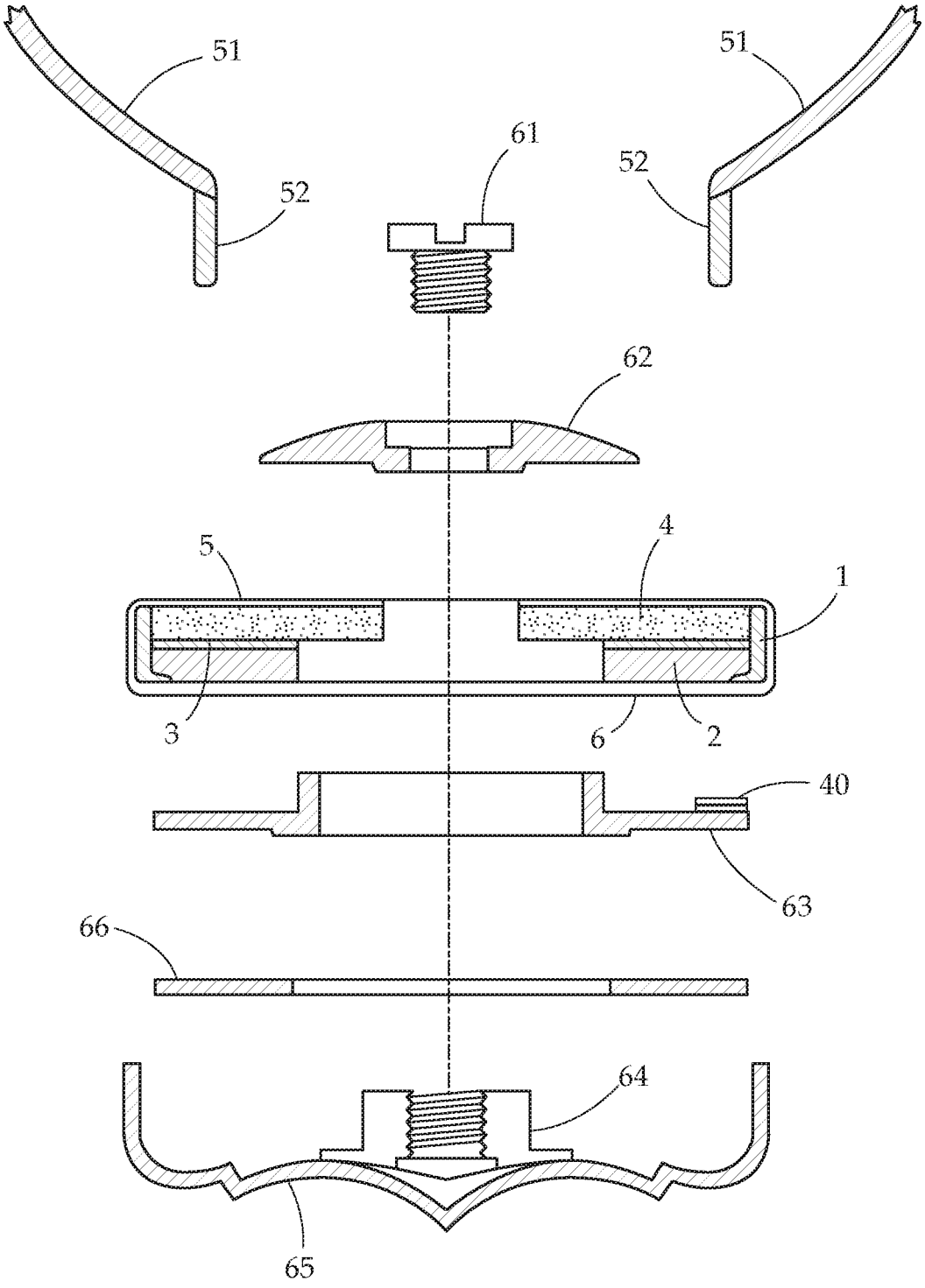
FIG. 6A provides an exploded view of an embodiment of the pad of the present disclosure installed in a key cup and held in place by a spud and washer assembly.

FIG. 6A provides an exploded view of an embodiment of the pad 10 installed in a key cup and held in place by a spud and washer assembly. Shims 40 are positioned on the pad base 63 to properly adjust the pad 10 orientation. An adhesive 66 joins the key cup 65 to the pad base 63. When assembled, screw 61 connects the washer 62, which has engaged the pad 10 and pad base 63 to the spud 64, holding the entire assembly in place along with the adhesive 66. The woodwind instrument 51 can be seen in a cutaway view, and the tonehole can be seen capable of being blocked by the pad 10 upper face when the pad is contacted to the tonehole.

Figure 6B:
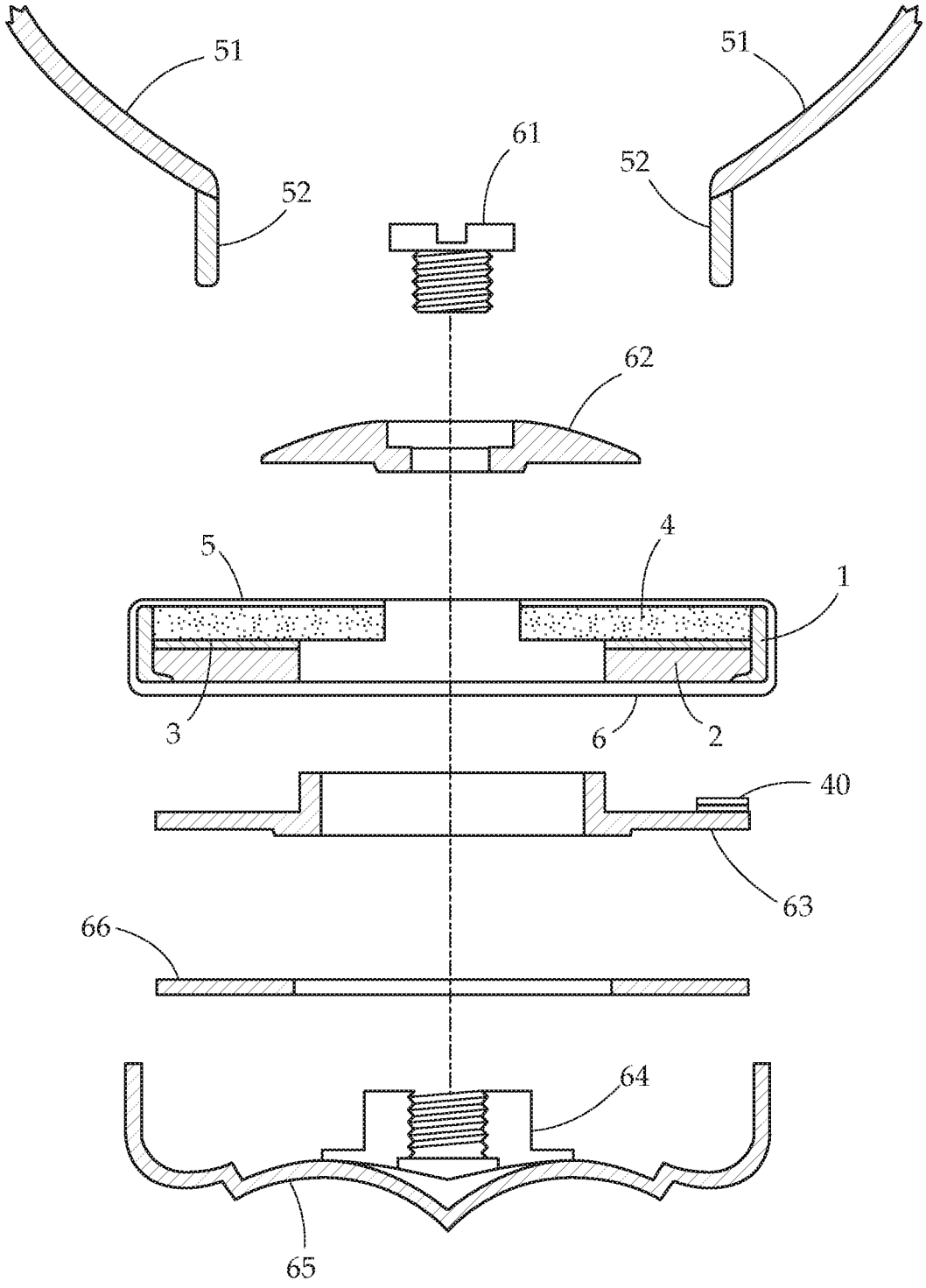
FIG. 6B provides an exploded view of an embodiment of the pad of the present disclosure installed in a key cup and held in place by a chimney attachment.

FIG. 6B provides an exploded view of an embodiment of the pad of the present disclosure installed in a key cup and held in place by a chimney attachment. Shims 40 are positioned on the pad base 63 to properly adjust the pad 10 orientation. The pad 10 of the present invention is shown having a partial cutaway shape at its bottom surface to engage with a chimney style pad base 63. An adhesive 66 joins the key cup 65 to the pad base 63. When assembled, screw 61 connects the washer 62, which has engaged the pad 10 and pad base 63 to the spud 64, holding the entire assembly in place along with the adhesive 66. The woodwind instrument 51 can be seen in a cutaway view, and the tonehole walls 52 can be seen capable of being blocked by the pad 10 upper face when the pad is contacted to the tonehole.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. A pad for a tonehole cover of a woodwind instrument comprising:

a pad material;

a pad ring retainer, the pad ring retainer having a vertical wall surrounding a vertical edge of the pad material; and wherein the pad ring retainer comprises a lower side with an inward taper extending inwardly from the vertical wall, the pad material abutting and being supported by the inward taper, the taper compressing the pad material.

2. The pad of claim 1 further comprising a membrane surrounding the pad material and the pad ring retainer.

3. The pad of claim 2 wherein a top of the vertical wall of the pad ring retainer forms an angled transition for the membrane from the vertical edge of the pad material to a top surface of the pad material.

4. The pad of claim 3 wherein the angled transition is an approximately 90 degree angle.

5. The pad of claim 1 wherein the pad material comprises a base layer and a cushion layer.

6. The pad of claim 1 further comprising a back label on a rear face of the pad material.

7. The pad of claim 1 wherein the pad material defines an inner opening concentric with the vertical wall of the pad ring retainer.

8. A pad assembly for a woodwind instrument comprising:

a key cup; and a pad secured to the key cup, the pad comprising:

a pad material;

a pad ring retainer, the pad ring retainer having a vertical wall surrounding a vertical edge of the pad material; and wherein the pad ring retainer comprises a lower side with an inward taper extending inwardly from the vertical wall, the pad material abutting and being supported by the inward taper, the taper compressing the pad material.

9. The pad assembly of claim 8 further comprising a membrane surrounding the pad material and the pad ring retainer.

10. The pad assembly of claim 9 wherein a top of the vertical wall of the pad ring retainer forms an angled transition for the membrane from the vertical edge of the pad material to a top surface of the pad material.

11. The pad assembly of claim 1 wherein the angled transition is an approximately 90 degree angle.

12. A woodwind instrument comprising:

a body;

a plurality of toneholes formed by the body;

a plurality of key cups, each positioned adjacent to one of the plurality of toneholes, each key cup movable between an open position allowing air flow through the adjacent one of the plurality of toneholes, and a closed position preventing air flow through the adjacent one of the plurality of toneholes; and a pad secured to each of the plurality of key cups, each pad comprising:

a pad material;

a pad ring retainer, the pad ring retainer having a vertical wall surrounding a vertical edge of the pad material; and wherein the pad ring retainer comprises a lower side with an inward taper extending inwardly from the vertical wall, the pad material abutting and being supported by the inward taper, the taper compressing the pad material.

13. The woodwind instrument of claim 12 wherein the instrument is one of a flute or a piccolo.

14. The woodwind instrument of claim 12 wherein the pad further comprises a membrane surrounding the pad material and the pad ring retainer.

15. The woodwind instrument of claim 14 wherein a top of the vertical wall of the pad ring retainer forms an angled transition for the membrane from the vertical edge of the pad material to a top surface of the pad material.

* * * * *